US007500454B2

(12) United States Patent
Frasure et al.

(10) Patent No.: US 7,500,454 B2
(45) Date of Patent: Mar. 10, 2009

(54) HIGH EFFICIENCY WATER HEATER

(76) Inventors: Charles Junior Frasure, 170 Park St., Blackfoot, ID (US) 83221; Blake David Frasure, 1830 Rainier Dr., Pocatello, ID (US) 83201; Greg Alva Frasure, 170 Park St., Blackfoot, ID (US) 83221; Paul Jon Frasure, 170 Park St., Blackfoot, ID (US) 83221

( * ) Notice: Subject to any disclaimer, the term of this patent is extended or adjusted under 35 U.S.C. 154(b) by 26 days.

(21) Appl. No.: 11/656,146

(22) Filed: Jan. 22, 2007

(65) Prior Publication Data

US 2008/0173259 A1 Jul. 24, 2008

(51) Int. Cl.
*F22B 7/08* (2006.01)

(52) U.S. Cl. ..... 122/18.4; 122/158; 122/160

(58) Field of Classification Search ..... 122/13.01, 122/17.1, 18.4, 33, 158, 160, 162, 155.2, 122/184; 138/38
See application file for complete search history.

(56) References Cited

U.S. PATENT DOCUMENTS 4,356,794 A * 11/1982 Bouman et al. ..... 122/158
4,424,768 A * 1/1984 Testa ..... 122/13.01
4,582,024 A * 4/1986 Wilhelm ..... 122/18.31
4,633,820 A * 1/1987 Montini ..... 122/37
4,909,191 A * 3/1990 Le Mer ..... 122/18.4
2006/0150927 A1 * 7/2006 Nightlinger et al. ..... 122/17.1

* cited by examiner

*Primary Examiner*—Gregory A Wilson

(57) ABSTRACT

A high efficiency water heater comprising a generally cone shaped tank; an surrounding and spaced from the tank defining a passageway for flue gases between an inner surface of the enclosure and the outer surface of the tank, said enclosure having an outlet for flue gases; a burner communicating with the interior of said enclosure, and means for providing combustion air to said burner. The preferred embodiment includes baffle means attached to the outer surface of the tank for increasing heat transfer. One embodiment has a conduit passing vertically through the tank, and wherein the burner is disposed in an upper region and communicating with the conduit, and includes a fan for directing flue gases downward through the conduit and subsequently into and through said passageway between the inner surface of the enclosure and the outer surface of the tank.

5 Claims, 4 Drawing Sheets

110
215
210
285
100
275
104
250
308
308
106
306
132
130
820
295

HIGH EFFICIENCY WATER HEATER

BACKGROUND OF THE INVENTION

This invention relates generally to water heaters, and specifically to a water heater with novel geometry and associated features to provide high efficiency.

Applicants prior U.S. Pat. No. 6,508,208 issued Jan. 31, 2003, to Frasure, et al. discloses a water heater having a conical bottom adapted to collect and dispose of sediment.

Applicants prior U.S. Pat. No. 7,100,541 issued Sep. 5, 2006, and U.S. Patent Application 20050109287 filed May 26, 2005 to Frasure, et al discloses a high efficiency tank type continuous flow and self cleaning water heater, having a flue pipe extending vertically through the tank, a cylinder disposed within the flue pipe, a burner disposed in a lower region of the cylinder, and a water conducing coil disposed within the cylinder connected with the interior of the tank.

SUMMARY OF THE INVENTION

It is an object of the present invention to provide a high efficiency, tank type, fuel-fired water heater.

It has been found a water heater having high efficiency can be provided by using a cone shaped tank and having combustion products contact the outer surfaces as they rise upwardly and outwardly along the tank surfaces.

The present invention provides a water heater comprising a generally cone shaped tank operatively oriented with a smaller cross-section disposed at a lower end thereof, and having a water inlet for connection with a water supply, and an outlet for heated water; an enclosure surrounding and spaced from the tank defining a passageway for flue gases between an inner surface of the enclosure and an outer surface of the tank, said enclosure having an outlet for flue gases; a burner communicating with the interior of said enclosure and means for providing combustion air to said burner.

DESCRIPTION OF THE PREFERRED EMBODIMENTS

Figure 1:
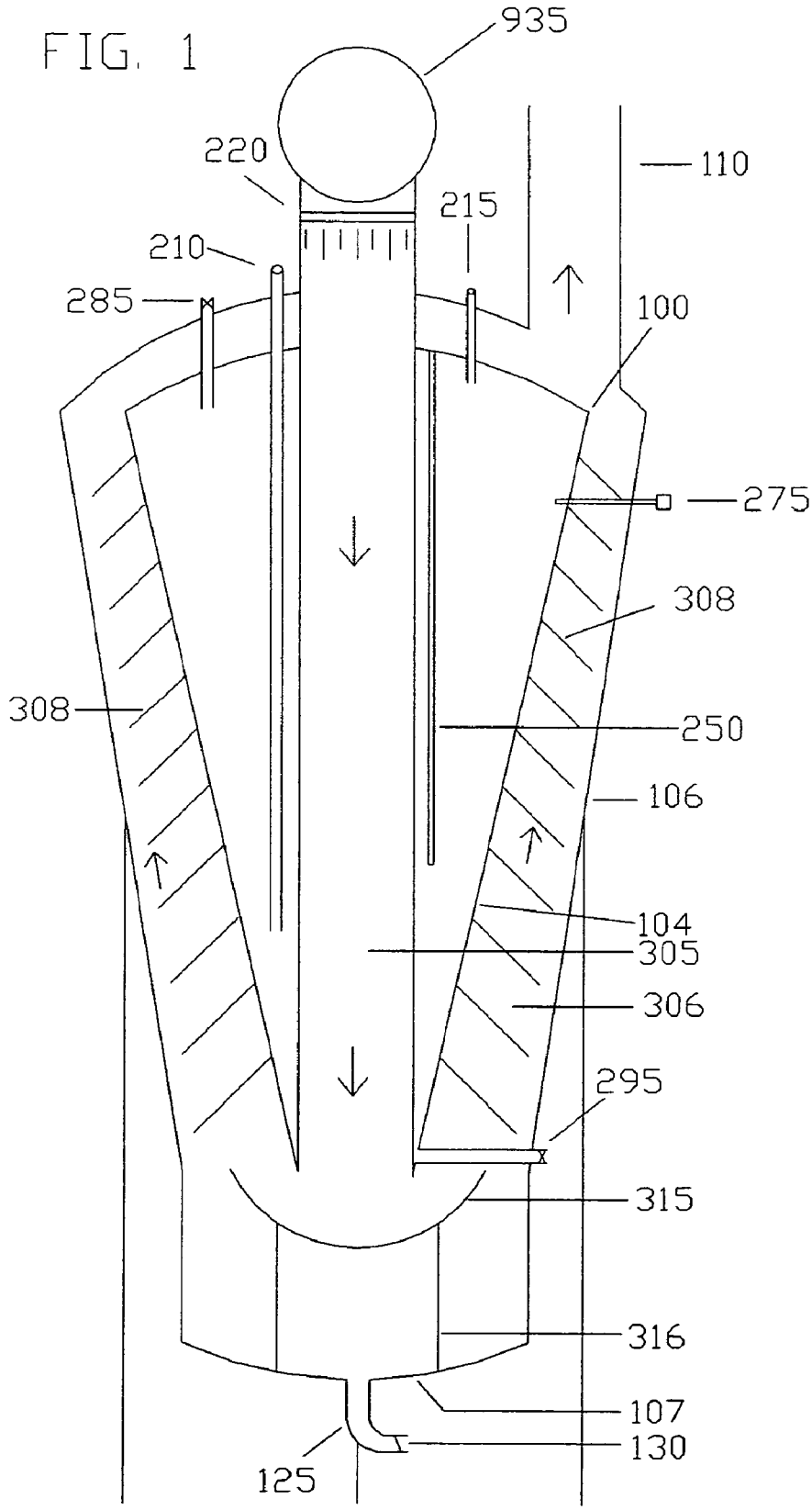
FIG. 1 is a schematic sectional view of one embodiment of a water heater in accordance with the present invention.

With reference to FIG. 1, the water heater of the present invention comprises a cone shaped tank 100 having a water inlet 210 for connection with a water supply, and a hot water outlet 215 connected to the tank interior. Surrounding and spaced from the tank 100 is an enclosure 106. The outer surface 104 of tank 100 and the inner surface 105 of enclosure 106 define the inner and outer wall, respectively, of flue passageway 306.

In the embodiment of FIG. 1, a flue pipe 305 extends vertically through the center of the tank 100 and exits at the bottom of the tank 100. A down draft burner 220 is located at the top of the central flue 305. Utilizing fan 935, hot gases flow down the vertical flue 305, around the outside of tank 100 through flue passageway 306 to the outlet/vent 110 located above the tank.

Since flue gas contacts the tank 100 both with downward flow, via the central conduit 305, and also upon upward flow via the passageway 306, high heat transfer to the tank with resulting high efficiency of the water heater is obtained.

Attached to the outside of the tank surface 104 are baffle means 308 for directing flue gas flow arranged to increase heat transfer to the tank. The baffle means 308 may be in the form of a plurality of discrete elements or in the form of a continuous spiral, as will be described in more detail below.

The central flue 305 will preferably also have baffle means designed to increase heat transfer. This baffle may be coated with a heat reflective material.

A deflector 315 is shown located below the bottom of flue 305 directing hot flue gases toward the flue passageway 306 to contact the baffle means 308 and tank 100 as the hot flue gases proceed to the outlet 110. The deflector 315 can be supported by suitable means in the lower area of the water heater, and may be coated with a heat reflective material.

The flue gas venting conduit and the conduit for receiving incoming combustion air may be arranged to exchange heat and may utilize a secondary fan.

FIG. 1 shows a plurality of baffle elements 308 attached to the exterior surface of the tank 100, attached for example, by welding. The baffle elements 308 are arranged to form a spiral around the tank with the desired pitch based upon the position, angle and dimension of the baffle elements 308, which increases the amount of hot gases coming in contact with tank surface 100 through conduction of heat through the baffle elements 308. The baffle elements 308 cause the flue gases to flow in a spiral around tank 100 to the top of the tank.

The baffle elements 308 will preferably be angled downward, directing the hot gases toward the surface of tank 100. Also, the baffle elements 308 will preferably be angled to direct flow to an adjacent element in an upward spiral.

The baffle means 308 can be attached to tank surface 100 by welding, or other suitable means.

The number and dimensions of the baffle elements 308 will be determined based on the appropriate number necessary to most effectively extract the maximum heat from the hot gases, and on the specific application, the desired flow pattern, water heater size, and flue gas volumes. The size of baffle elements 308 can vary, but would typically be 1 to 6 inches long and 1 to 6 inches wide depending on the particular water heater size or design and extend out into the flow of hot gases. The baffle elements 308 would extend to within typically 0.5 to 1 inch of the outer flue wall 106 but the distance would vary depending on the size and application of the water heater. The location and arrangement of baffle elements 308 may be varied, and may be limited to specific areas of the tank.

The baffle elements 308 may be provided with a crease, or bent at an angle for rigidity and to provide desired heat flow control.

In another embodiment of the baffle elements 308, the edge that extends from the tank surface toward the outside flue wall would contain a downwardly pointing lip/protrusion running the entire length of the side of the baffle means. The lip/protrusion would prevent the heat flow from backing up and exiting the under side of the baffle element in the wrong direction. The opposite side of the baffle element would contain a lip of the same length, but it would not extend as far.

Condensation forming on the baffle elements 308 would drip from the baffle means 308 onto the outer flue wall 106 and collect in the area of drain 125 located at the bottom of the water heater 107. The bottom of the water heater 107 would contain a drain 125 leading to a building drain. The drain 125 would contain a check valve 130 which would allow water to exit to a drain, but prevent combustible gases from entering the drain tube/pipe or combustion area of the water heater. The bottom of the tank 100 would contain a drain pipe 295. The drain pipe would contain an appropriate shut of valve.

In another embodiment, the baffle means 308 may be in the form of a raceway arranged in a continuous spiral around the tank 100. The raceway is preferably angled downward for increasing the contact of flue gas with the tank while flowing upward around the outside of the tank. The bottom side of the raceway and the tank surface will preferably be provided with protrusions to slow the flow rate of the hot gases allowing for enhanced heat transfer to the tank 100 surface.

In another embodiment, the flue utilizes a water conducing coil in the flue 305 or in the exit vent pipe 110. Baffle means may be utilized to increase the amount of hot gases coming in contact with the flue wall and or the water conducing coil.

Figure 2:
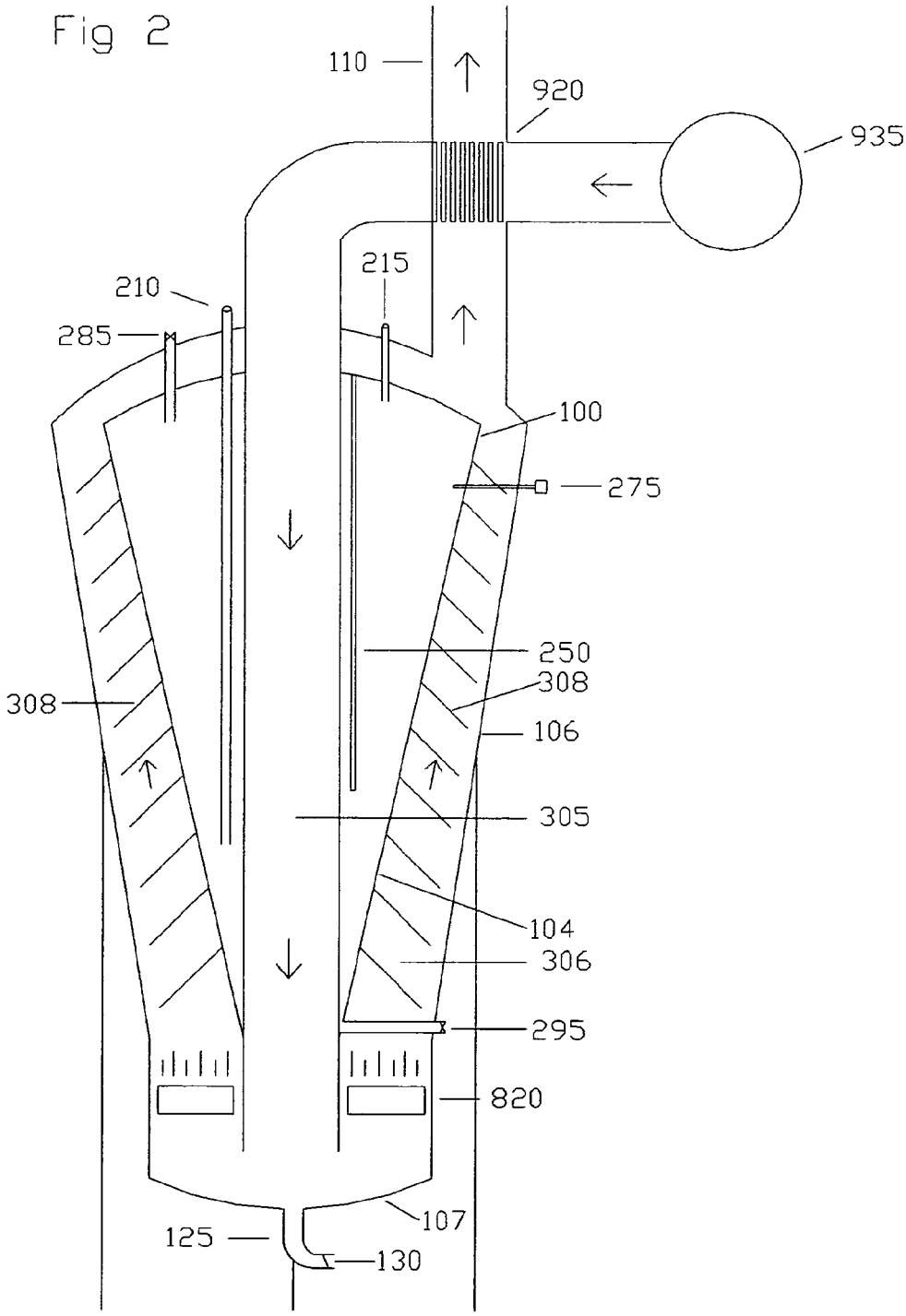
FIG. 2 is a schematic sectional view of another embodiment of the invention, having a central conduit for combustion air.

In the embodiment shown in FIG. 2, the incoming air passes through a heat exchanger 920 which would be located in the flue 110 above tank 100, through the vertical flue 305 up flue 306 and past or through heat exchanger 920 to the exit air vent 110. A fan 935 may be used at the inlet or outlet to facilitate flow. Baffle means 308 would be attached to the outside surface of tank 100 as described in FIG. 1. The incoming air would have the option of being piped in from outside and entering the combustion chamber from the bottom of the water heater. The condensation would drain through the drain 125 located in the bottom of the water heater. The drain 125 would contain an optional check valve 130 to prevent combustible gases from entering.

Figure 3:
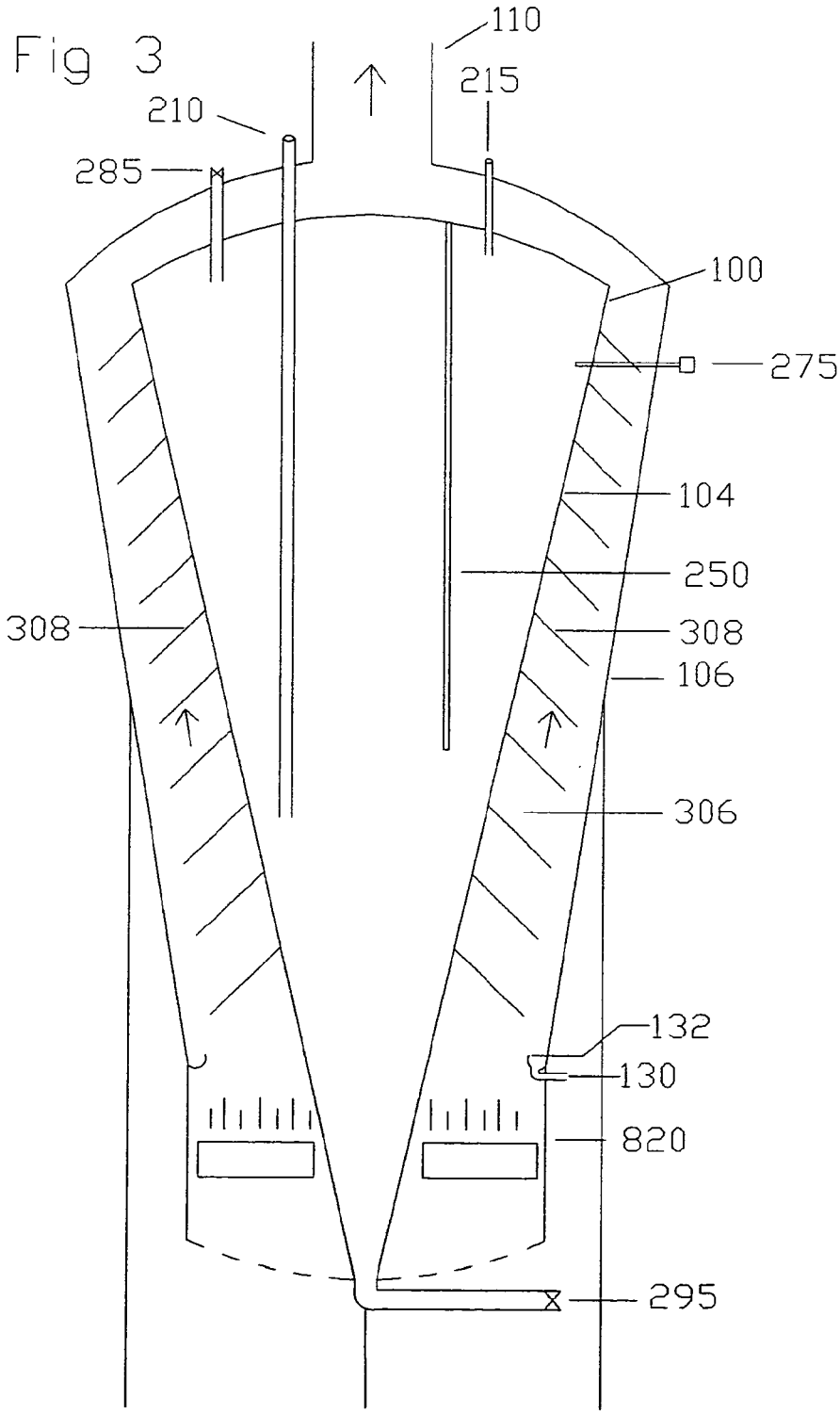
FIG. 3 is a schematic sectional view of another embodiment of the invention.

The bottom of the tank would contain a drain pipe 295. The drain pipe would contain an appropriate shut of valve In the embodiment shown in FIG. 3, the incoming air enters the combustion chamber of the water heater in the area below the burner located at the bottom of or lower area of the tank. The burner 820 would preferably be a ring burner. The hot gases flow from the burner up through baffle elements located in flue 306 as described in FIG. 1 and the air flow then proceeds to the exit air vent 110.

A lip 130 is shown located around the inside of the lower section of the wall of the water heater to catch condensation and direct it to a drain 132 attached to the lip. The drain would contain an optional check valve to prevent combustible gases from entering the combustion area. The lowest point of the tank would contain a drain pipe 295 leading to a drain. The drain pipe 295 would contain an appropriate shut of valve.

Figure 4:
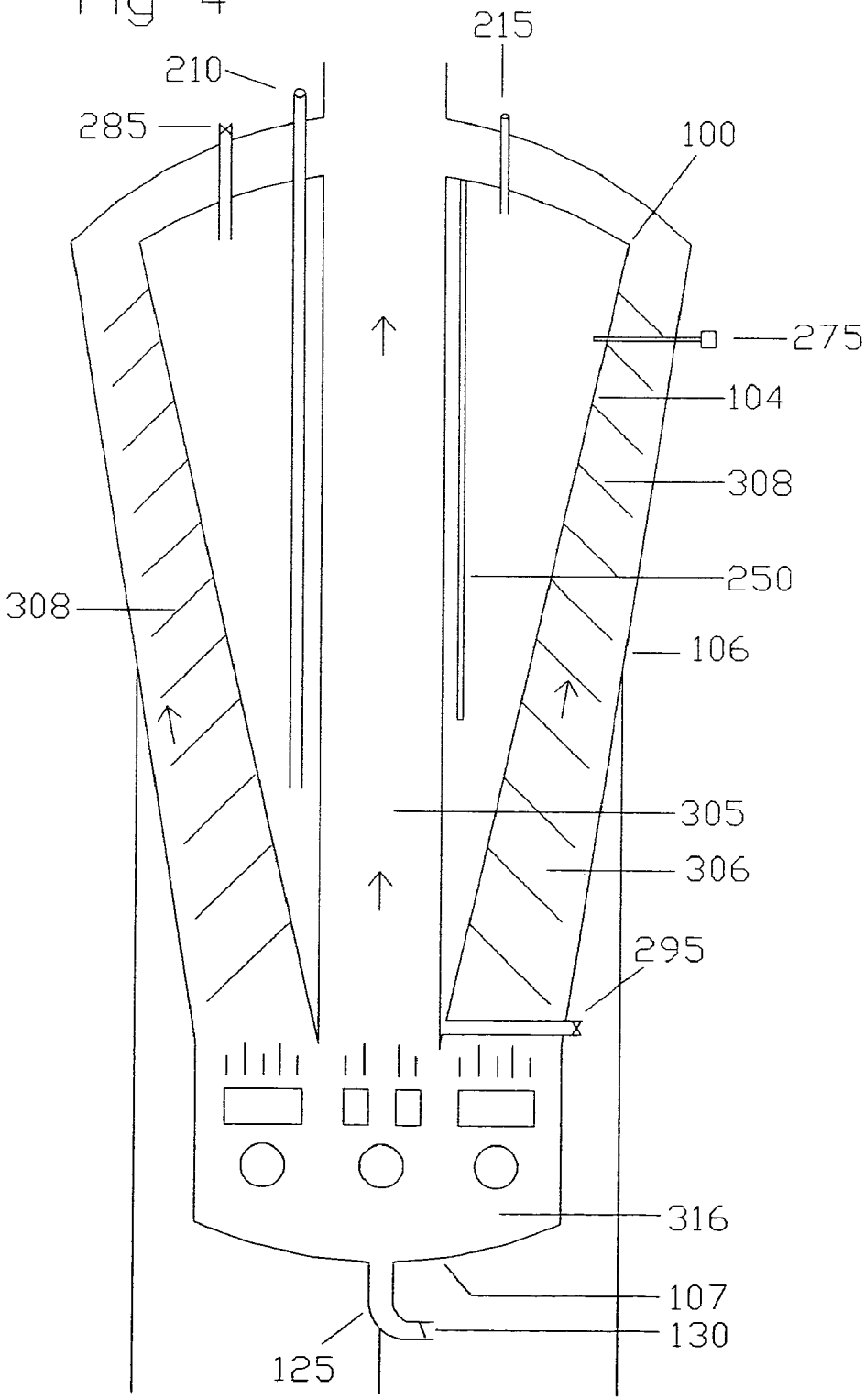
FIG. 4 is a schematic sectional view of another embodiment of the invention having a central conduit for flue gases.

In the embodiment shown in FIG. 4, the incoming air enters in the bottom area of the water heater below the burners. The hot gases then proceed up flues 306 and 305 and exit through exit vent 110. Flue 305 would contain baffle means and or water conducing coil. The burner could be a ring burner or one of various types of burners. Condensate from flue 305 is collected at drain 125.

It will be understood that features described in one of the embodiments described herein may be utilized in another embodiment. Following are additional features which may be utilized.

All embodiments may include a heat exchanger that transfers heat from the outlet vent to incoming air. This can achieved by having the outlet vent pass through the air inlet conduit. Heat transfer fins could be added to the outside of the outer wall of flue 106 and extend to the outside of the water heater skin to allow the heat to be utilized to heat the room it is located in.

All embodiments can include a raceway leading to drain 295 at bottom of the tank 100 to reduce scale build up as described in patent applicant's U.S. Pat. No. 6,508,208. There are a number of methods currently used to remove sediment from water heater tanks that can be utilized. Also, various methods can be utilized to drain condensation from the bottom of the water heater. Also suitable means can be employed to prevent an explosion from occurring due to a combustible gas entering the combustion chamber from outside the water heater In all embodiments, the baffle element can be in the in form of a stud, preferably a rectangular stud.

Any of the embodiments herein may utilize features presently used in water heaters, such as: sensors, controls and pressure relief valves to control the temperature and prevent overheating and explosion, an anode rod 250, condensate traps, the use of corrosion resistant materials, a water conducting coil in the flue or vent pipe, etc.

The burner of the embodiments herein may operate on oil, natural gas, propane or other fuel.

The invention claimed is:

1. A water heater comprising:

a generally cone shaped tank operatively oriented with a smaller cross-section disposed at a lower end thereof, and having a water inlet for connection with a water supply, and an outlet for heated water;

an enclosure surrounding and spaced from the tank defining a flue passageway for conducting flue gases between an inner surface of the enclosure and an outer surface of the tank, said enclosure having an outlet for flue gases;

a burner communicating with the interior of said enclosure, and means for providing combustion air to said burner;

a conduit passing generally vertically through the tank; and wherein said conduit is connected with an inlet for combustion air, and including a heat exchanger operatively interconnecting said inlet for combustion air and the outlet for flue gases.

2. The water heater of claim 1 including a fan for supplying combustion air to the burner through said conduit.

3. A water heater comprising:

a generally cone shaped tank operatively oriented with a smaller cross-section disposed at a lower end thereof, and having a water inlet for connection with a water supply, and an outlet for heated water;

an enclosure surrounding and spaced from the tank defining a flue passageway for conducting flue gases between an inner surface of the enclosure and an outer surface of the tank, said enclosure having an outlet for flue gases;

a burner communicating with the interior of said enclosure, and means for providing combustion air to said burner;

a conduit passing generally vertically through the tank, and wherein the burner is disposed in an upper region and communicating with the conduit, and including a fan for directing flue gases downward through the conduit and subsequently into and through said passageway between the inner surface of the enclosure and the outer surface of the tank.

4. A water heater comprising;

a generally cone shaped tank operatively oriented with a smaller cross-section disposed at a lower end thereof, and having a water inlet for connection with a water supply, and an outlet for heated water;

an enclosure surrounding and spaced from the tank defining a flue passageway for conducting flue gases between an inner surface of the enclosure and an outer surface of the tank, said enclosure having an outlet for flue gases;

a burner communicating with the interior of said enclosure, and means for providing combustion air to said burner;

baffle means attached to the outer surface of the tank for increasing heat transfer; and wherein the baffle means are in the form of a raceway arranged in a spiral about the tank.

5. The water heater of claim 4 wherein the baffle means are in the form of a plurality of downward sloping baffle elements for directing flue gas flow towards the tank.

* * * * *